United States Patent [19]

Thurmond, Jr.

[11] 4,257,471

[45] Mar. 24, 1981

[54] STRIP CURTAIN DOOR

[75] Inventor: Elmer T. Thurmond, Jr., Miami, Fla.

[73] Assignee: Equipment Company of America, Hialeah, Fla.

[21] Appl. No.: 956,542

[22] Filed: Nov. 1, 1978

[51] Int. Cl.[3] ..... A47H 1/00

[52] U.S. Cl. ..... 160/332

[58] Field of Search ..... 160/189, 332; 248/226.2, 226.3, 316 B, 316 C; 24/2.5, 3, 67.1, 67.3, 67.5, 67.7, 73 AS,.73 B, 73 BP, 73 CE, 73 MC, 73 MS, 259 R

[56] References Cited

U.S. PATENT DOCUMENTS

| | | | |
|---|---|---|---|
| 147,362 | 2/1874 | Bourden | 248/226.3 |
| 2,662,715 | 12/1953 | McKnight | 248/226.3 |
| 3,931,919 | 1/1976 | Gerber et al. | 248/316 C |
| 4,086,950 | 5/1978 | Power | 160/332 |

FOREIGN PATENT DOCUMENTS

| | | | |
|---|---|---|---|
| 975286 | 9/1975 | Canada | 160/332 |
| 558170 | 12/1943 | United Kingdom | 160/332 |

*Primary Examiner*—Peter M. Caun

*Attorney, Agent, or Firm*—Cullen, Sloman, Cantor, Grauer, Scott & Rutherford

[57] ABSTRACT

A strip curtain door is adapted for positioning across a door opening having a header with a curtain rod spanning the opening at the top thereof. Hanger brackets support the rod and are secured to the header. A series of spaced opposed pairs of arcuate clips are loosely mounted upon the rod, each clip having a depending finger. A series of upright flat flexible strips of plastic material have their adjacent edges overlapped, extend across the opening over the height thereof with upper portions of each strip projected between a plurality of the pairs of clips. A fastener extends between the fingers of each pair of clips and through the strips whereby the fingers of the clips compressively engage and support the strips. In a modification, one finger of each pair of clips has a transverse dimple, with the other finger having an opposing transverse hole therethrough. Securing of the clips together forms a dimple in the strip which is projected into the finger hole for interlock therewith. Another modified clip includes a pair of spaced fingers, there being a dimple in one finger of each clip and a hole in the other finger of each clip. The clips are symmetrical with the dimples of one finger projecting within the hole in the opposing finger forming a plurality of dimples in the strips which interlockingly project within corresponding opposing holes in the fingers. In another modification, each finger of each clip has a plurality of dimples and/or holes therein, which may be alternated with the other finger of each clip having an alternate arrangement of holes and dimples and wherein, the symmetrical clips when secured together in opposing registry form a plurality of projecting dimples in the flexibel strips compressively held therebetween by the clip fingers.

10 Claims, 12 Drawing Figures

STRIP CURTAIN DOOR

BACKGROUND OF THE INVENTION

Heretofore, in conjunction with an opening in a wall that separates one room from another or provides an access opening to an interior space and wherein, it is inconvenient to have rigid door closing said opening, heat energy or cooling energy, noise or dust will normally pass through such opening. The problem has existed of providing a practical means of providing a temporary closure for such opening to permit the passage of persons or things therethrough and wherein, some means could be provided for reclosing the opening to isolate one space from another.

SUMMARY OF THE INVENTION

It is an object of the present invention to provide a strip curtain door for such opening wherein, a series of plastic, flexible strips of material may be yieldably hung across such opening in order to save energy, to reduce noise, to control air-borne particles and which is so constructed as to facilitate deflection of parts thereof to permit the passage of persons or things through such opening.

It is a further object to provide a multiple-strip curtain door adapted for positioning across a door opening for sound proofing or noise control, for thermo control, such as a passageway for a freezer locker or the like, a passage control for loading docks, for the protection of flying objects around machine tools or maintaining conditioned air upon the interior of a room or building, at the same time, permitting easy passage or vision through the curtain. The present strip curtain door is further applicable for use in openings in car washes, to save energy or to protectively enclose a welding area to prevent movement of sparks or particles therefrom.

It is another object to provide a strip curtain door for positioning across a door opening having a header and wherein, there is suspended across said opening, a series of overlapped flexible strips of plastic material together with a series of opposed pairs of clips which are loosely mounted upon the rod and which have opposed depending fingers adapted to secure upper edge portions of the strips together when the fingers have been fastened together.

These and other objects will be seen from the following specification and claims in conjunction with the appended drawings.

THE DRAWINGS

It will be understood that the above drawing illustrates merely a preferred embodiment of the invention, and that other embodiments are contemplated within the scope of the Claims hereafter set forth.

DETAILED DESCRIPTION OF THE INVENTION

Figure 1:
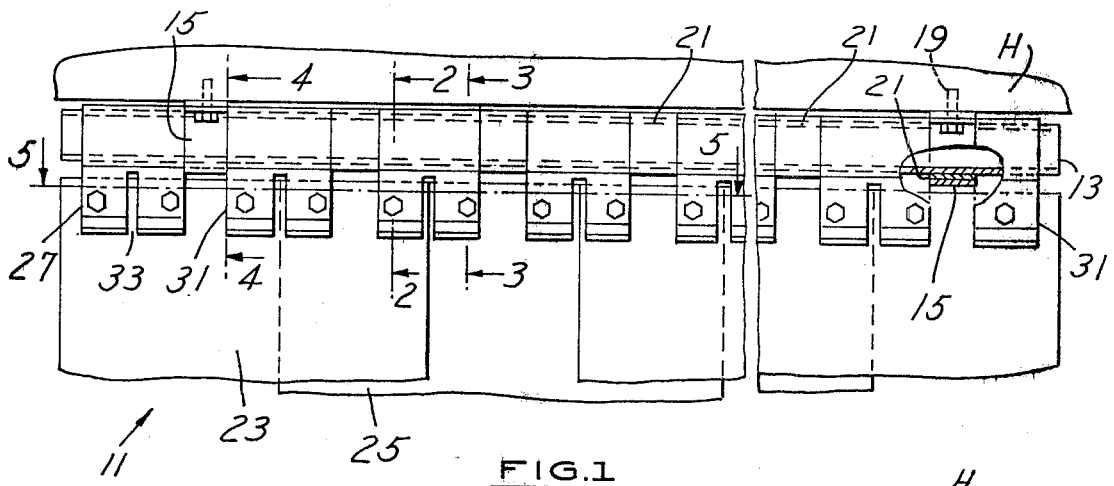
FIG. 1 is a fragmentary elevational view of the present strip curtain door positioned across a door opening.

Referring to the drawings, the present strip curtain door is generally indicated at 11, FIG. 1, positioned across a door opening, having a header H or lintel.

Figure 4:
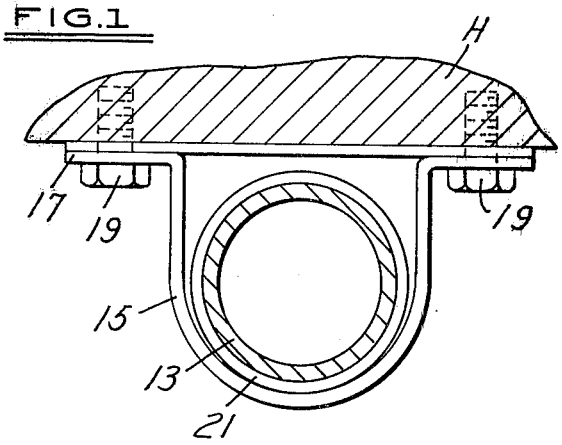
FIG. 4 is a similar section taken in the direction of arrows 4—4 of FIG. 1.

A curtain rod 13 extends across said opening adjacent said header and is supported and secured thereto by at least a pair of spaced U-shaped hangers 15 whose outturned legs 17 are secured to said header as by fasteners 19, FIG. 4. Cylindrical spacers 21 are mounted upon said rod and interposed between said rod and the hanger brackets 15 as shown in FIG. 1.

A series of upright, flat, flexible strips 23 of plastic material, preferably of uniform width, are suspended from said curtain rod with their adjacent longitudinal edges overlapped at 25 and extending across the width of said opening and substantially throughout the height thereof. Upper edge portions of the respective overlapped strips are projected between a plurality of spaced, opposed pairs of arcuate clips 27 loosely mounted over and along the length of said bar.

A plurality of spacers 21 are mounted upon the curtain rod, alternate with and engage adjacent pairs of opposed clips along the length of said rod, as shown in FIG. 1.

Each of the opposed pair of clips has a body 29 which is substantially semi-circular in shape and terminates in one or a pair of laterally spaced fingers 31.

Figure 2:
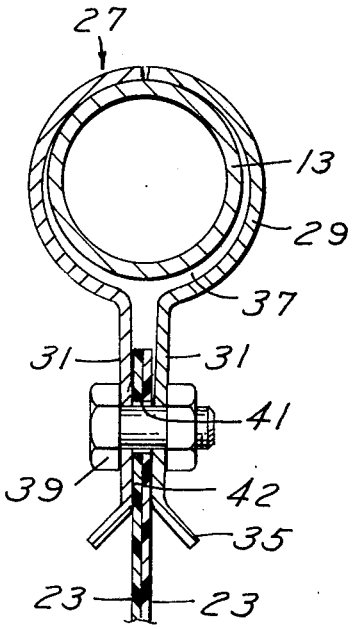
FIG. 2 is a fragmentary section on an increased scale taken in the direction of arrows 2—2 of FIG. 1.
Figure 5:
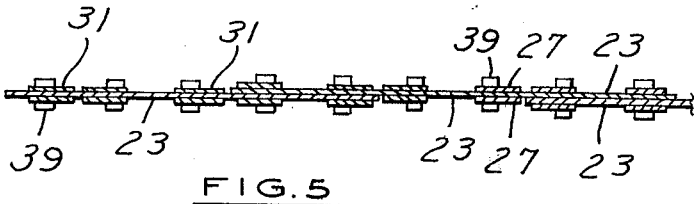
FIG. 5 is a fragmentary plan section taken in the direction of arrows 5—5 of FIG. 1.

As shown in FIG. 1, most of the opposed pairs of clips have downwardly opening slots 33 defining within each clip a pair of laterally spaced fingers 31. In the illustrative embodiment, there is shown one additional clip at the right end of the rod in FIG. 1 which is of such size as to complete the space at the end of the rod and, thus, includes a single depending finger 31. The clips are arranged in opposed pairs with the corresponding opposed fingers 31 converging downwardly as shown in FIG. 2 and at their lower end, each terminating in the out-turned or angular flanges 35.

Each of the clips 27 are oversized with respect to the outside diameter of the rod as shown by the clearance at 37 so that the opposed pair of clips, when fastened together, are loosely and pivotally and flexibly mounted upon said rod. This facilitates flexing movements of the depending curtain door strips 23 during the passage of a person or thing through the opening, normally closed by the hanging of said strips in a substantially vertical plane.

Fasteners 39 extend between the fingers of each pair of clips and through preformed apertures 41 in adjacent portions of the strips for supporting said strips and compressively engaging and securing said strips between the clamping areas 42 adjacent and normally below the fasteners 39. The fastener 39 is primarily used as a clamping device and not as a shear connector to support the plastic strips 23. Thus, the plastic strips are supported by the clamping or compressive action of the fingers 31 rather than by the bolts 39 which extend through the holes 41 in the strips 23.

In the illustrative embodiment, the strips 23 for a particular installation are normally uniform in width such as 8, 12 or 16 inches, for example, with the corresponding thickness being respectively 0.08 inches, 0.12 inches, and 0.16 inches. The 8-inch width is used usually on smaller interior doors where there is mostly pedestrian traffic. The 12-inch width is used on medium size interior-exterior door openings and the 16-inch width is used on large doors where there is heavy vehicular traffic, light wind, negative building pressure or where the extra thickness is desired for sound attenuation.

The present strips are provided of a suitable plastic material which is transparent. One illustration of material is polyvinyl chloride (PVC), which material may be of various grades and thicknesses and widths and with variable overlaps to meet any particular door closure requirement.

In the illustrative embodiment, a standard grade PVC which is employed will withstand temperatures from −30 degrees F. to +160 degrees F. and may be used for external or interior doors.

The present pairs of clips grip the upper edge portions of the overlapped strips in such a manner that they are swivelly or hingedly mounted and suspended from the rod and, thus, allow the passage of tall loads therethrough without causing damage to the strips.

The outwardly directed flanges 35 at the lower ends of the clips serve as a means of rounding or softening the lower edge of the clips where the plastic material flexes in order to prevent the sharp edges of the clips from cutting the plastic material.

Since the fingers 31 converge downwardly as shown in FIG. 2, the opposed clamping areas 42 below the fasteners are brought together for gripping or clamping or compressing portions of the strips therebetween.

Figure 3:
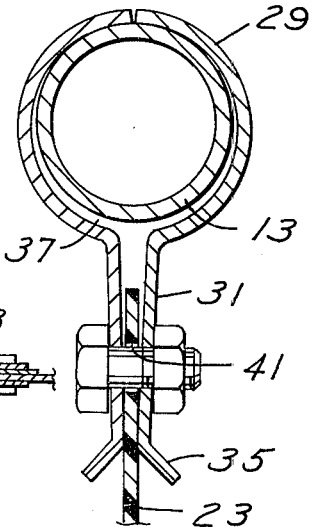
FIG. 3 is a similar section taken in the direction of arrows 3—3 of FIG. 1.

FIG. 2 illustrates a gripping between a pair of opposed clips of a pair of overlapped strips 23. FIG. 3 illustrates the accommodation between a pair of opposed clips of a single curtain layer, as shown in FIG. 1. Accordingly, the slot 33 in the respective clips defining the spaced fingers 31 provides for the individual flexibility to the extent that the opposed clips, when secured together, may accommodate one or a pair of overlapped strips.

Figure 6:
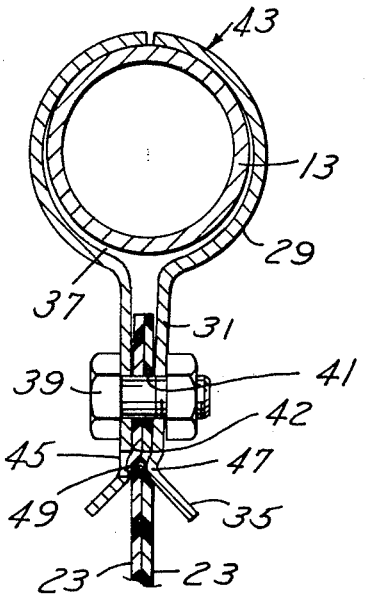
FIG. 6 is a vertical section corresponding to FIG. 2 showing a modified strip curtain door and clips.
Figure 7:
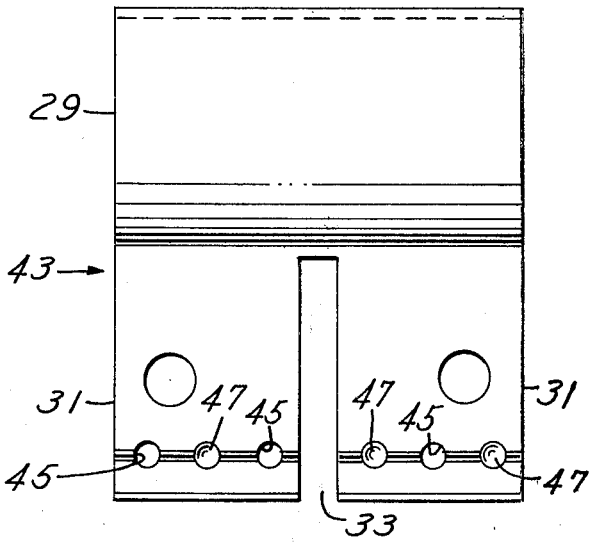
FIG. 7 is a right side elevational view of the modified clip shown in FIG. 6.

A modified clip 43 is shown in FIGS. 6 and 7 at 43, consisting of a pair of opposed bodies 29 and wherein, adjacent the clamping areas 42 of said fingers, there is formed in one opposing finger a transverse hole 45 therethrough. A dimple 47 is formed in the opposing finger for registry with said hole whereby, upon securing the fingers together, on tightening of the fastener 39, dimples 49 are formed in the strips 23 with at least one of said dimples projecting laterally into the adjacent hole 45 for an interlock therewith. A corresponding single hole 45 and dimple 47 may be formed in the opposing fingers in the embodiment shown in FIG. 2 to provide an additional interlock of portions of the curtain strips by the formation of dimples 49 therein for further anchoring upper edge portions of the curtains 23 as overlapped between a pair of clamped-together clips.

In the embodiment shown in FIG. 7, corresponding to FIG. 6, within one of the fingers 31 of each clip, there is formed a pair of spaced holes 45 therethrough and an intermediate dimple 47. The other finger of the modified clip 43 has a spaced pair of dimples 47 formed therein and an intermediate hole 45. The respective clips 43 are symmetrical so that when they are arranged opposing each other as a pair, as shown in FIG. 6, the dimples 47 of one finger are in cooperative registry with the corresponding holes 45 of the opposing finger. Thus portions of the single layer or double layer of strips 23 have multiple dimples formed therein adapted for interlocking projection within the corresponding holes 45 of the adjacent finger.

While each of the fingers in the clips 43, FIG. 7, show a pair of holes and an intermediate dimple or a pair of dimples and an intermediate hole, it is contemplated that each of the fingers could have merely one hole and one dimple on one side and upon the opposite side, one dimple and one hole. With the opposed clips being symmetrical, when assembled and secured together at their gripping areas 42, the dimple of one finger will be in cooperative registry with the corresponding hole of the opposing finger for forming an additional dimple within the one or pair of overlapped curtain strips for interlocking projection within the adjacent finger hole 45.

Accordingly, in the modification shown in FIG. 7, one finger thereof may have a single hole and the other finger, one corresponding dimple, or there may be a hole and a dimple in each finger in alternated fashion, or there may be a pair of holes and an intermediate dimple in one finger and a corresponding pair of dimples and intermediate hole in the other finger. Since these are symmetrical clips, when assembled and secured together, they provide a plurality of transverse dimples in the adjacent curtain strip portions 23 for cooperative interlock with the adjacent finger aperture.

Figure 8:
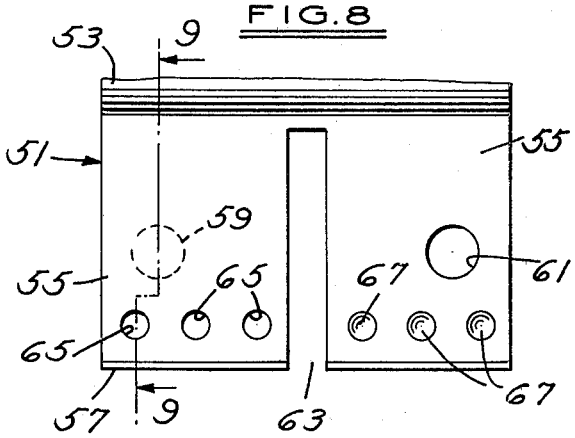
FIG. 8 is a fragmentary view similar to FIG. 7 showing a modified clip.
Figure 9:
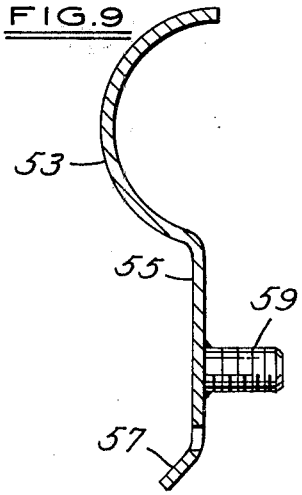
FIG. 9 is a section taken in the direction of arrows 9—9 of FIG. 8.

A modified clip is shown at 51 in FIGS. 8 and 9, similar to the modification 43 of FIG. 7 except that, depending from the semi-circular body 53, fragmentarily shown, there are a pair of fingers 55 defined by the slot 63 therebetween with each finger terminating in the out-turned or tapered flange 57.

In this embodiment, the threaded stud 59 forming a part of a fastener projects from one of the fingers 55, the corresponding other finger having a hole 61 therethrough. Since the clips 51 are symmetrical, upon assembly of a pair of such clips together, the respective studs 59 of each pair of clips extend through corresponding apertures 61 of said pair of clips.

In the modified clip 51 shown in FIG. 8, there is shown a plurality of transverse holes 65 formed through one finger of each clip, with the other finger of each clip having a corresponding series of dimples 67. Again, since the clips are symmetrical, when a pair of said clips are assembled together in the manner shown in FIG. 6 and secured together as by fasteners 59, the dimples 67 from one finger will be in cooperative registry with the corresponding opposed holes 65 of the adjacent finger so that adjacent portions of the plastic strips 23 will have dimples formed therein in the manner shown in FIG. 6 to provide a further interlock of said strips with said assembled pairs of clips.

While the embodiment of FIGS. 8 and 9 shows in one finger of each clip the three apertures 65, and in the other finger three dimples, it is contemplated that the arrangement of holes and dimples could be modified in the manner shown in FIG. 7. As an example, some dimples may be provided in one finger and one or more dimples in the adjacent finger. Alternately, a construction of clips such as shown in 51, FIG. 8, in connection with the integral stud 59 may have formed therein one or two or three or a plurality of alternating holes and dimples. Since the clips are symmetrical, there will be cooperative registry of the dimples with respect to the opposing holes 65 in such a manner that adjacent portions of the curtain strips clamped therebetween at the clamping areas 42 interlockingly project into holes 65 of adjacent clip fingers.

Figure 10:
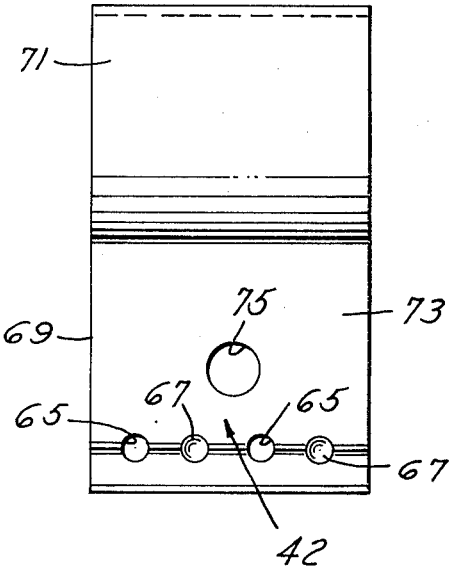
FIG. 10 is a side elevational view of a further modified clip.

A modified clip 69 is shown in FIG. 10 having a semi-circular body 71 the same as above described with respect to FIG. 2 and which terminates in the depending finger 73 having a transverse hole 75 therethrough adapted to receive a fastener similar to the fastener 39 of FIG. 2.

Within the clamping area 42 shown in FIG. 10, adjacent and below the fastener aperture, there are formed a series of alternating holes 65 and dimples 67 in the finger 73. The corresponding symmetrical clip 69, when arranged in an opposed pair upon the supporting rod 13, provides an additional set of symmetrically arranged alternating holes 65 and dimples 67. The dimples from one finger are adapted for cooperative registry with the correponding holes 65 of the opposing finger for the purpose of forming interlocking dimples within portions of the clamped strips 23 secured between said fingers.

While the modification of FIG. 10 shows the series of alternating holes and dimples, the number of holes and dimples could be modified as above described.

Figure 11:
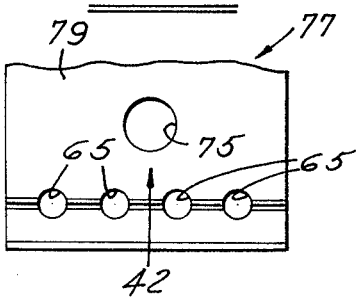
FIG. 11 is a fragmentary side elevational view of a further modification of one of a pair of opposed clips.
Figure 12:
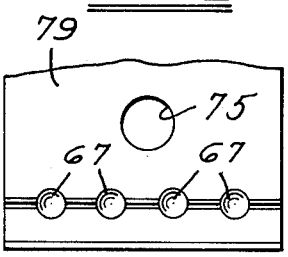
FIG. 12 is a fragmentary side elevational view of the other of said opposed pair of clips.

A further modified clip is fragmentarily shown at 79, FIGS. 11 and 12, representing a pair of opposed clips whose fingers 79 have formed therethrough corresponding opposed apertures 75 to receive a fastener such as fastener 39. Adjacent the clamping areas 42, there are formed within one of the pair of fingers 79 a plurality of spaced holes 65 therethrough. In the non-symmetrical corresponding opposing finger shown in FIG. 12, there are provided a corresponding series of spaced dimples 67 adapted for registry with the corresponding holes 65 in the adjacent finger. Within and adjacent the clamping areas 42, portions of the strips retained between the opposing clips, when assembled together, will have formed therein dimples which interlockingly project within corresponding holes 65 of the clip 77 shown in FIGS. 11 and 12.

Upon clamping of the respective fingers together, such as shown in FIG. 2, the fingers remain non-parallel and converging towards each other to thus define the clamping areas 42 adjacent the fastener 39 for further gripping the strips 23 therebetween. In those modifications which include dimples and corresponding apertures, the compressing together of the adjacent strips forms additional interlocking dimples within the strips which partly extend into the adjacent finger aperture for a further interlock of the strip with the clips.

Since, in most of the embodiments described, the opposed clips of each pair of clips are symmetrical, there is provided a simplified manufacturing process which provides for the formation of a single clip and wherein, the pairs of clips being symmetrical facilitate assembly together, at reduced cost.

The present strip curtain door is adapted to save energy since the door will be open only enough to allow personnel, equipment or loads to pass through the opening and then automatically close. This reduces the loss of heated or cooled air.

The present construction will also reduce noise and absorb sound when such enclosure is used around noisy machinery without blocking off light, visibility or access to the area.

The present strip curtain door is also adapted to control air-borne particles. Thus, such curtain door will prevent the spread of dust, smoke and sparks by keeping them in the areas where they originate. Such strip curtain will also prevent the entry of birds and flying insects.

The present strip curtain door requires no special tools or skills for assembly. The individual components, including the strips, are pre-punched and ready for assembly.

For certain types of strip curtain doors some of the strips, such as the outer edge strips or a center divider strip, may be of a contrasting different color for delineating either the sides of the opening or the center of a passageway, or both.

In normal use, the respective strips forming the strip curtain door function by gravity to normally be maintained in a vertical plane such as shown in FIG. 1.

While a standard overlap of adjacent edge portions of the strips 23 is shown at 25, FIG. 1, it is contemplated that there may be substantially full overlap between adjacent pairs of strips. Optionally, the overlap may be in the form of a ship lap with the respective strips being substantially parallel to each other in either a full or partial overlap as desired to meet the needs of a particular installation.

Having described my invention, reference should now be had to the following Claims.

I claim:

1. In a strip curtain door adapted for positioning across a door opening having a header, an elongated curtain rod spanning the door opening at the top thereof, spaced hanger brackets supporting said rod and secured to said header, a series of upright elongated flat flexible strips of plastic material with their adjacent edges overlapped to form a double thickness of plastic strip material, with the strips being of uniform thickness throughout and extending across said opening over the height thereof pivotally suspended at their upper ends from said rod; the improvement which comprises:

a series of clips loosely, pivotally and flexibly mounted on said rod and spaced longitudinally apart along the length of said rod;

said clips each having a pair of opposed semicircular symmetrical bodies mounted on said rod, each body having two downwardly extending fingers which are spaced longitudinally apart below said rod and which converge toward the opposite fingers of the opposed body of the clip, each clip being slotted defining a pair of said fingers therein with the opposite fingers on a pair of opposed bodies being laterally spaced apart to receive therebetween either a single thickness or a double thickness of plastic strip material;

a fastener carried by each finger of one body of each clip and extending either through an opening provided in a single thickness or in a double thickness of plastic strip material and thereafter extending through an opening provided in the opposite finger of the other opposed body of the clip;

the inner surfaces of said opposite fingers on the opposed bodies below the corresponding fastener forming clamping surfaces;

each of the openings in the plastic strip material being larger than the diameter of the corresponding fastener to provide clearance between the fastener and the plastic strip material to insure that when the clamping surfaces of each pair of opposite fingers are urged together upon tightening of the corresponding fastener, the single thickness or the double thickness of plastic strip material therebetween, is frictionally held, supported and clamped solely by said opposite fingers on said opposed bodies of the clamp and is not carried by the fastener, whereby the fasteners also constitute the sole means for holding said clamps on said rod.

2. In the strip curtain door of claim 1, a pair of opposed bodies forming one clip having one pair of opposite fingers receiving and supporting a single thickness of plastic strip material and the other pair of opposite fingers on said opposed bodies receiving and supporting a double thickness of plastic strip material therebetween.

3. In the strip curtain door of claim 1, one finger of each pair of opposite fingers having a tranverse dimple, the other finger of each pair of opposite fingers having an opposing transverse hole therethrough, the assembly and securing together of said opposite fingers urging the dimple of said one finger into the plastic strip material between such opposite fingers forming a corresponding dimple in said plastic strip material which is in turn projected into said finger hole and interlocked with said other opposite finger.

4. In the strip curtain door of claim 1, one finger on one body of one clip having a transverse dimple and the other finger on said one body having a transverse hole therethrough, there being a corresponding hole and dimple in the other fingers of the other opposed body of said clip, each finger dimple forming a corresponding dimple in said plastic strip material which is in turn projected into the corresponding finger hole for interlock with said other opposed fingers; the dimples formed in said plastic strip material extending in opposite directions.

5. In the strip curtain door of claim 1, one finger of each pair of opposed bodies having a transverse dimple and a transverse hole therethrough, the other finger of each pair of opposed bodies having an opposed corresponding hole and dimple; the securing together of said pair of opposed bodies forming corresponding dimples in the adjacent plastic strip material which are in turn projected into the opposite holes for interlock with said fingers.

6. In the strip curtain door of claim 1, one finger of each pair of opposed bodies having a pair of spaced dimples and an intermediate hole therethrough; the other finger of each pair of opposed bodies having corresponding opposed pairs of holes and an intermediate dimple therethrough, forming a plurality of dimples in said plastic strip material projecting into the holes of opposing fingers and interlocked with the fingers.

7. In the strip curtain door of claim 1, one finger of each pair of opposed bodies having a plurality of spaced dimples; the other finger of each pair of opposed bodies having a plurality of opposed holes therein, said dimples forming a plurality of interlocking dimples in said plastic strip material which are projected into said opposed holes of said other fingers and interlocked therewith.

8. In the strip curtain door of claim 1, one finger of each pair of opposed bodies having a plurality of spaced alternating dimples and holes therein; the other finger of each pair of opposed bodies having corresponding opposed alternating holes and dimples therein, the bodies of said clips when secured together forming a corresponding plurality of oppositely directed dimples in the adjacent plastic strip material, each of which is projected into a corresponding hole and interlocked with said fingers.

9. In the strip curtain door of claim 1, each fastener including a stud secured to each finger of said one body of each clip which extends through said opening provided in the opposed finger of the other body of said clip.

10. In the strip curtain door claim 1, said fingers at their one ends having an outwardly diverging flange providing rounded surfaces engaging edge portions of said plastic strip material as the material is flexed between the bodies of the clips, preventing the lower sharp edges of said fingers from cutting into said plastic strip material.

* * * * *